US012420210B2

(12) United States Patent
Royal et al.

(10) Patent No.: US 12,420,210 B2
(45) Date of Patent: Sep. 23, 2025

(54) BOBBLEHEAD KEY CHAIN

(71) Applicant: Bobbleheads.com, LLC, Alpharetta, GA (US)

(72) Inventors: Rachael Royal, Canton, GA (US); Brandon Royal, Canton, GA (US); Warren Royal, Alpharetta, GA (US)

(73) Assignee: Bobbleheads.com, LLC, Alpharetta, GA (US)

( * ) Notice: Subject to any disclaimer, the term of this patent is extended or adjusted under 35 U.S.C. 154(b) by 113 days.

(21) Appl. No.: 18/369,982

(22) Filed: Sep. 19, 2023

(65) Prior Publication Data

US 2024/0091657 A1 Mar. 21, 2024

Related U.S. Application Data

(60) Provisional application No. 63/407,935, filed on Sep. 19, 2022.

(51) Int. Cl.

| | |
|---|---|
| ***A63H 3/00*** | (2006.01) |
| ***A44B 15/00*** | (2006.01) |
| ***A63H 3/48*** | (2006.01) |

(52) U.S. Cl.

CPC ..... *A63H 3/003* (2013.01); *A44B 15/007* (2013.01); *A63H 3/48* (2013.01)

(58) Field of Classification Search

CPC ..... A63H 3/003; A63H 3/48; A44B 15/00; A44B 15/007

USPC ..... 446/72

See application file for complete search history.

(56) References Cited

U.S. PATENT DOCUMENTS 1,362,348 A * 12/1920 Patelis ..... G10K 1/071 116/150
1,528,463 A * 3/1925 Yungk ..... G10K 1/071 116/148
1,848,020 A * 3/1932 Merrill ..... G10K 1/32 116/150
3,139,855 A * 7/1964 Kunz ..... G10K 1/071 84/103
4,484,535 A * 11/1984 Hayward ..... G10K 1/10 116/156

(Continued)

OTHER PUBLICATIONS https://public.3.basecamp.com/p/mqiRwRzxLzPSpzneHv6z8iby.
https://www.amazon.com/Funko-Pocket-Punisher-Bobblehead-Keychain/dp/B019UF1QWQ/ref=cm cr arp d pl foottop?ie-UTF8.

*Primary Examiner* — Joshua D Huson

(74) *Attorney, Agent, or Firm* — Silverline Legal, PLLC; Tynia A. McQuigg; Drew T. Palmer

(57) ABSTRACT

The present disclosure relates to a bobblehead key chain. In one aspect, the bobblehead key chain includes a head having a top opening on an upper surface of the head, a bottom opening on a lower surface of the head, and a mounting feature located within an interior space of the head. The bobblehead key chain also includes a pivot mechanism disposed through the interior space of the head, where the pivot mechanism includes a spine that extends through the top opening of the head and an axle that extends from the spine. The axle is retained by the mounting feature. The bobblehead key chain may also include a connection feature at the top of the pivot mechanism to allow key rings, keys, or other objects to be attached to the bobblehead key chain. The bobblehead key chain may also include a body connected to the pivot mechanism.

10 Claims, 7 Drawing Sheets

(56) References Cited

U.S. PATENT DOCUMENTS

| | | | | |
|---|---|---|---|---|
| 6,027,752 | A * | 2/2000 | Coleman | A23G 3/54 446/73 |
| 6,346,664 | B1 * | 2/2002 | Shuen | G10K 1/071 446/419 |
| 6,402,580 | B1 * | 6/2002 | Coleman | A23G 3/50 446/72 |
| 6,722,308 | B1 * | 4/2004 | Moulden | G10K 1/072 116/171 |
| 7,048,605 | B2 | 5/2006 | Hawthorne et al. | |
| 2004/0244671 | A1 * | 12/2004 | Murray | G10K 1/071 116/171 |
| 2005/0095949 | A1 * | 5/2005 | Fernandez, Jr. | A63H 33/107 446/236 |
| 2008/0207085 | A1 | 8/2008 | Goldberg | |

* cited by examiner

BOBBLEHEAD KEY CHAIN

CROSS-REFERENCE TO RELATED APPLICATIONS

This application claims the benefit of U.S. Provisional Patent Application No. 63/407,935 filed Sep. 19, 2022, and incorporates said provisional application by reference into this document as if fully set out at this point.

BACKGROUND OF THE INVENTION

1. Field of the Invention

This invention generally relates to a bobblehead key chain.

2. Description of the Related Art

A wide variety of key chains and novelty key chains are known, ranging from simple rings to chains and toy figurines attached to a ring for holding keys. Also, a wide variety of bobblehead dolls are known, ranging from dolls that have an oscillating head connected to a spring in the neck of the doll to those that have a head that bobbles due to springs attached to the lower body or base of the doll.

Bobblehead key chains are rare, and those that exist are rudimentary and do not allow for movement of the head separately from the body and/or the key chain itself. For instance, some known bobblehead key chains merely attach a ring on the head of the bobblehead doll. The head of such a key chain does not bobble independently of the ring; rather, the body will move very slightly, while the head is fixed to the ring. Utilizing a ring attached to the top of a traditional bobblehead doll's head is also problematic because the weight of the body will distort the spring that is either inside the neck of the doll or serves as the neck. Stretching of the spring can cause loss of the desired bobbling movement. Further, the compromised spring creates a high risk of eventual breakage of the doll's head from the body.

Bobblehead key chains that, instead, attach a ring onto one side of a traditional bobblehead doll's body also fail to create the desired bobbling effect because the off-centered attachment throws off the head's center of gravity.

It is therefore desirable to provide an improved bobblehead key chain that is simple in structure, yet durable and inexpensive, and above all, able to still provide a bobbling movement of the head that is separate from the movement of the body. Moreover, it is desirable to provide a bobblehead doll that may accommodate various shapes, sizes, and weights in design.

BRIEF SUMMARY OF THE INVENTION

This disclosure relates to a bobblehead key chain. In one aspect, the bobblehead key chain includes a head and a pivot mechanism disposed through an interior space of the head. The head also includes a top opening located on an upper surface of the head, a bottom opening located on a lower surface of the head, and a mounting feature located within the interior space. The pivot mechanism includes a spine that extends through the top opening and an axle entending from the spine, where the axle is retained by the mounting feature.

In one embodiment, the pivot mechanism includes a connection feature at the top of the spine.

In one embodiment, the mounting feature includes a first recess and a second recess, where the first recess holds one end of the axle, and the second recess holds an opposite end of the axle.

In one embodiment, the head includes a first portion and a second portion connected to the first portion, such that the interior space of the head is between the first portion and the second portion.

In one embodiment, the first portion and the second portion are connected by snaps, screws, clips, glue, or pins.

In one embodiment, the spine extends through the bottom opening of the head.

In one embodiment, the bobblehead key chain includes a body connected to the spine of the pivot mechanism.

In one embodiment, the body is a unitary piece with the spine.

In one embodiment, the head and the body are shaped to resemble a person, an animal, or a fictional character.

In one embodiment, the head includes bottom stops within the interior space.

In one embodiment, the spine is reinforced with structural ribs.

In another aspect, the bobblehead key chain includes a head with a top opening, a pivot mechanism disposed through the head and extending through the top opening, and a body connected to the pivot mechanism. The pivot mechanism includes a spine and a connection feature at the top of the spine.

In one embodiment, the head includes a bottom opening that is opposite from the top opening, an interior space between the top opening and the bottom opening, and a mounting feature located within the interior space.

In one embodiment, the pivot mechanism includes an axle extending from the spine, where the axle is retained by the mounting feature of the head.

In one embodiment, the mounting feature includes a first recess and a second recess, where the first recess holds one end of the axle, and the second recess holds an opposite end of the axle.

In one embodiment, the head includes bottom stops within the interior space.

In yet another aspect, a method of making a bobblehead key chain is disclosed, where the method includes the step of constructing a pivot mechanism that includes a spine, an axle extending from the spine, and a connection feature above the axle of the spine. The method further includes the step of forming a head around the spine of the pivot mechanism, such that the axle is retained in a mounting feature of the head, and the step of fastening the connection feature to a key ring.

In one embodiment, the step of forming the head around the spine includes the step of connecting a first portion of the head to a second portion of the head with a snap, a screw, a clip, glue, or pins.

In one embodiment, the method also includes the step of molding a body at a lower end of the spine, such that the body and the spine are a unitary piece.

In one embodiment, the method also includes the steps of creating a top opening in an upper surface of the head and creating a bottom opening in a lower surface of the head.

Accordingly, a new and improved bobblehead key chain is disclosed that prevents breakage of the body from the neck or head by utilizing a pivot mechanism instead of previously known springs and that allows movement of the head separate from the body.

A further object of the bobblehead key chain is that may be shaped to resemble specific people, animals, fictional characters, or objects.

BRIEF DESCRIPTION OF THE DRAWINGS

These and further aspects of the invention are described in detail in the following examples and accompanying drawings.

DETAILED DESCRIPTION OF THE INVENTION

Figure 1:
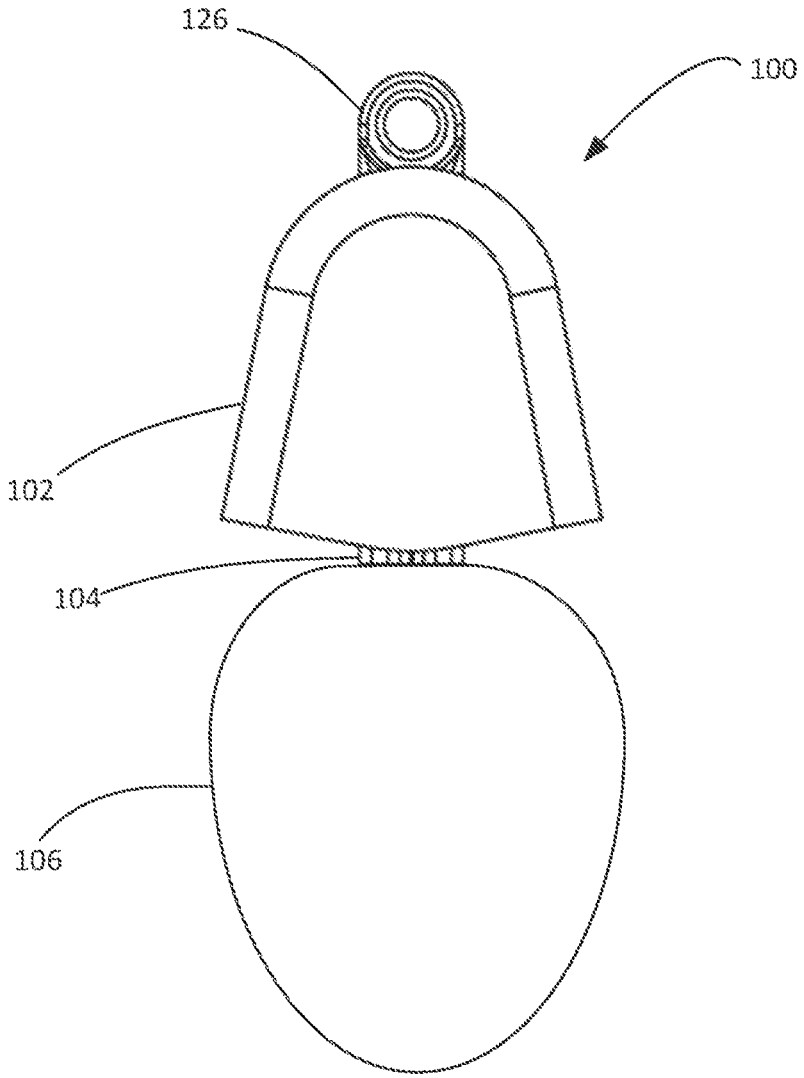
FIG. 1 is a front elevation view of an example of a bobblehead key chain in accordance with an illustrative embodiment of the invention disclosed herein.

While this invention is susceptible of embodiment in many different forms, there are shown in the drawings and will herein be described hereinafter in detail some specific embodiments of the invention. It should be understood, however, that the disclosure is to be considered an exemplification of the principles of the invention and is not intended to limit the invention to the specific embodiments so described.

Referring now to the figures of the drawings, wherein like numerals of reference designate like elements throughout the several views, FIG. 1 depicts a bobblehead key chain 100 having a bobbling head 102, a pivot mechanism 104 disposed through the head 102, and a body 106 configured below the head 102. In some embodiments of the bobblehead key chain 100, the body 106 is omitted.

The head 102 includes a first portion 108 and a second portion 110, which may be a unitary construction or separate pieces that are connected together to form the head 102. The first portion 108 and the second portion 110 may be connected together via snaps, screws, clips, glue, pins, or other suitable fasteners. In one embodiment, the first portion 108 is oriented as the front of the head 102, and the second portion 110 is oriented as the back of the head 102. In another embodiment, the first portion 108 is orientated as one side of the head, and the second portion 110 is oriented an opposing side of the head 102. The head 102 also includes an interior space 112 between the first portion 108 and the second portion 110.

Figure 2:
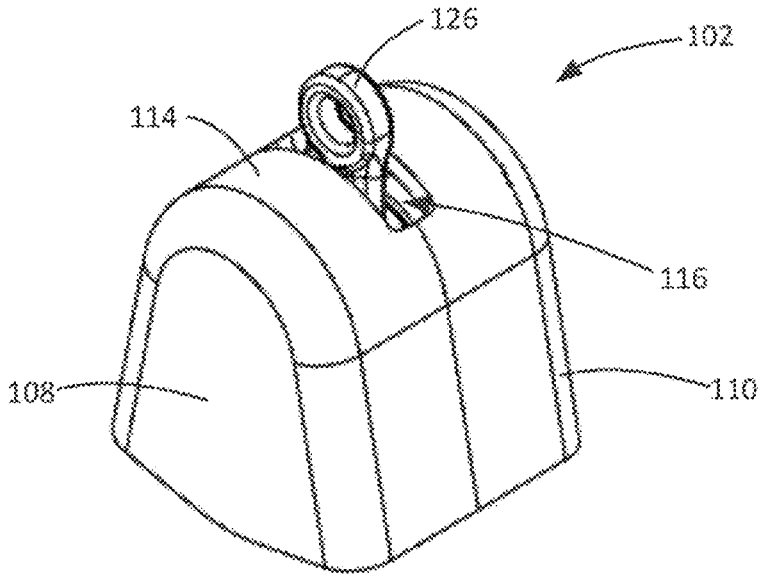
FIG. 2 is a top perspective view of the head of the bobblehead key chain in FIG. 1.
Figure 3:
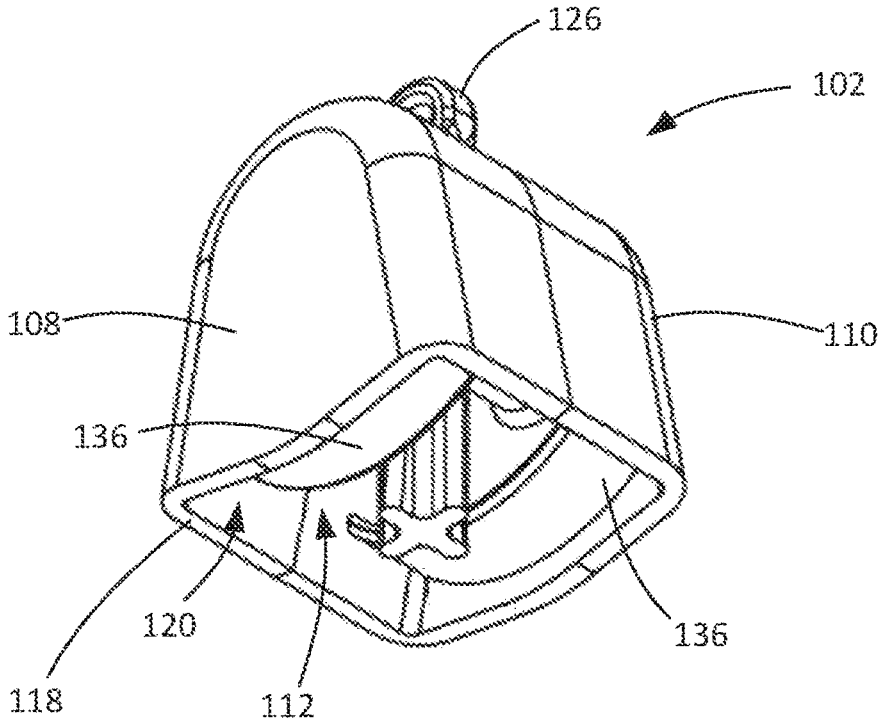
FIG. 3 is a bottom perspective view of the head of the bobblehead key chain in FIG. 1.
Figure 8A:
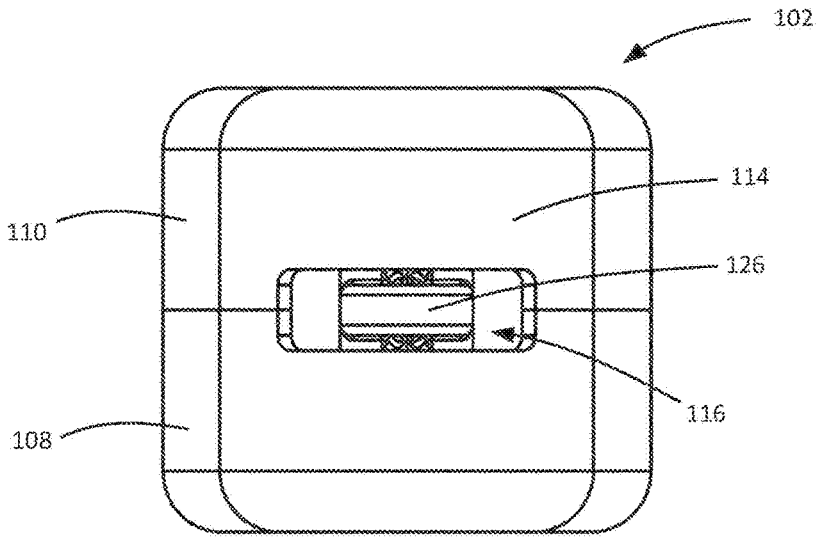
FIG. 8A is a top elevation view of the head of the bobblehead key chain in FIG. 1.

As shown in the exemplary embodiment of FIGS. 2 and 3, an upper surface 114 of the head 102 has a top opening 116, and a lower surface 118 of the head 102 has a bottom opening 120 that is opposite to the top opening 116. FIG. 8A depicts an alternative view of the top opening 116 of FIGS. 2 and 3, demonstrating that the top opening 116 is generally rectangular and centrally positioned on the upper surface 114. It will be appreciated that other shapes and sizes for the top opening 116 and the bottom opening 120 may be suitable in various embodiments of the head 102. The interior space 112 is between the top opening 116 and the bottom opening 120. In one embodiment, the top opening 116 and the bottom opening 120 are formed when the first portion 108 and the second portion 110 are connected. In another embodiment, the top opening 116 and the bottom opening 120 are cut, drilled, or otherwise formed after the first portion 108 and the second portion 110 are connected. Where the head 102 is of unitary construction, the head 102 may be initially constructed with the top opening 116 and the bottom opening 120, or the openings 116, 120 may be subsequently created in the upper surface 114 and the lower surface 118.

Figure 4:
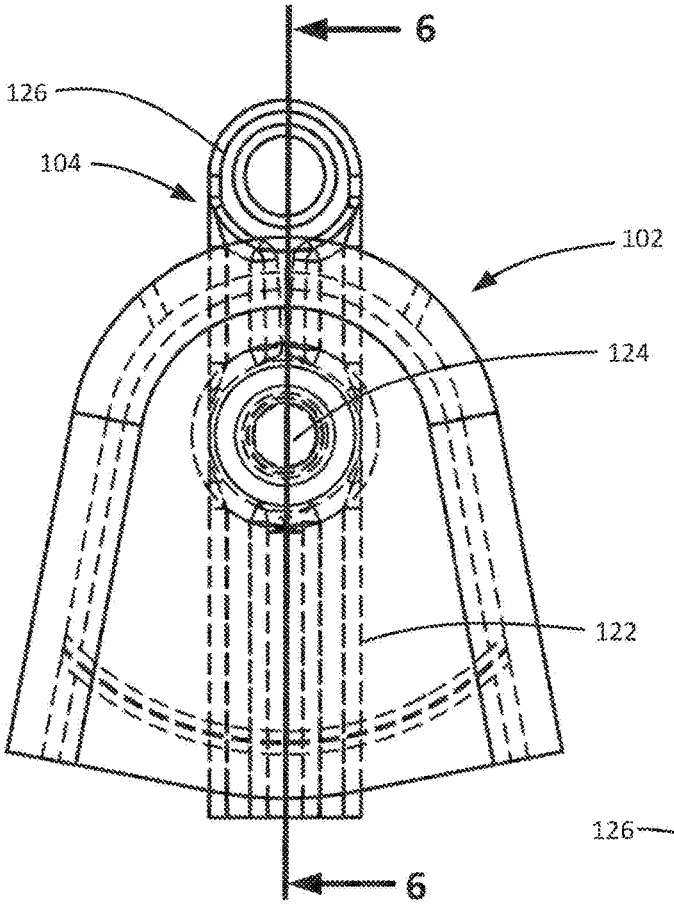
FIG. 4 is a front partial cutaway view of the head of the bobblehead key chain in FIG. 1.

The pivot mechanism 104 is disposed through the interior space 112 of the head 102 and serves as the fixed portion of the bobblehead key chain 100 about which the head 102 bobbles. FIG. 4 depicts an exemplary embodiment of the pivot mechanism 104 disposed through the head 102. In some embodiments, the bobblehead key chain 100 is made by first constructing the pivot mechanism 104, and by molding or otherwise forming the head 102 about the pivot mechanism 104. In other embodiments, the head 102 is constructed and the pivot mechanism 104 is subsequently disposed and retained therein.

Figure 7:
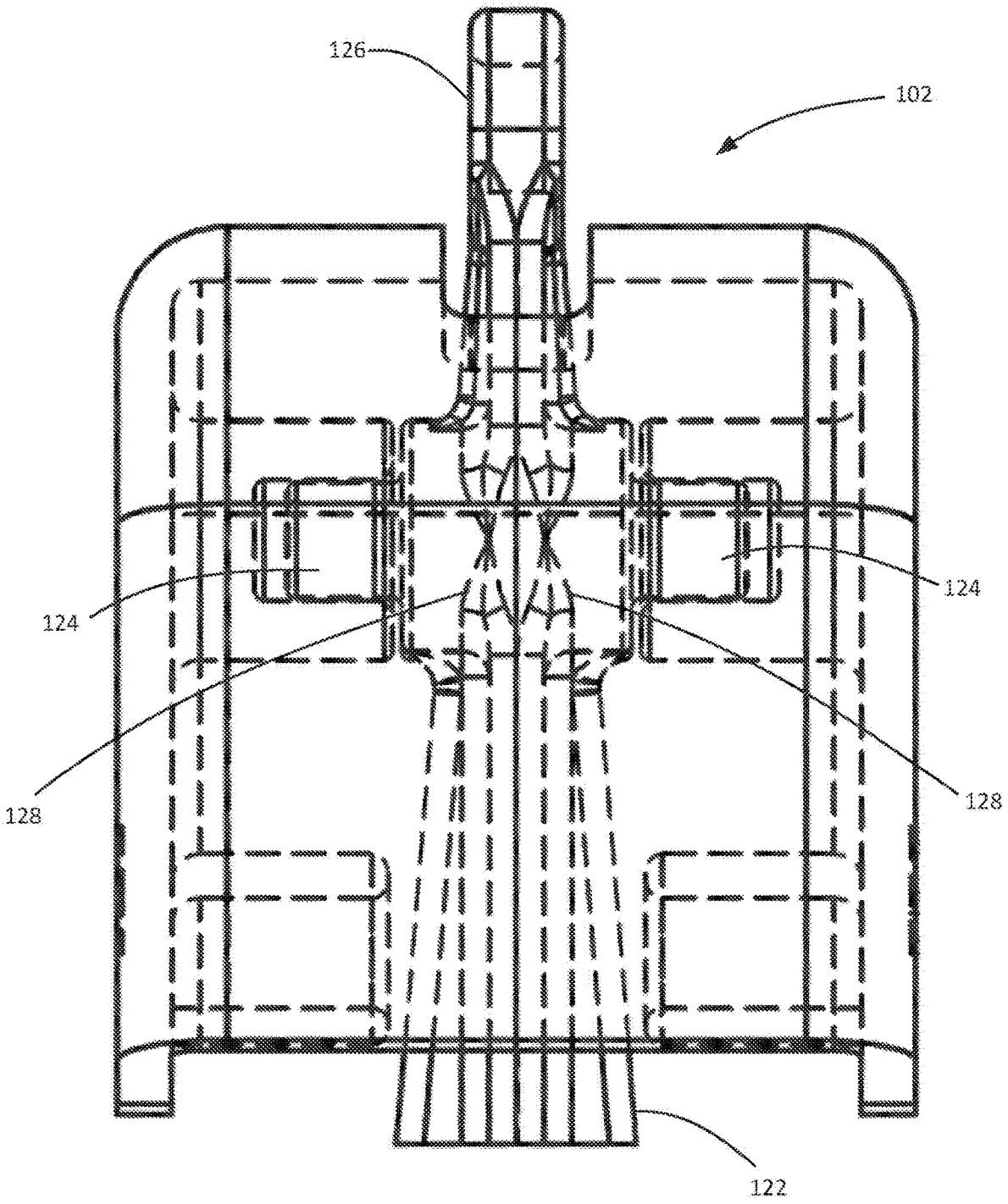
FIG. 7 is a side partial cutaway view of the head of the bobblehead key chain in FIG. 1.

The pivot mechanism 104 includes a spine 122, an axle 124 extending perpendicularly from the spine 122, and a connection feature 126 above the axle 124 at the top of the spine 122. In some instances, the spine 122 is reinforced with structural ribs 128, as depicted in FIG. 7. The pivot mechanism 104 may be a unitary piece or may be constructed from separate pieces, which are connected together via snaps, screws, clips, glue, pins, or other suitable fasteners. For example, in one embodiment, the connection feature 126 is a separate piece while the spine 122 and the axle 124 are of unitary construction. In another embodiment, the connection feature 126 and the spine 122 are of unitary construction, while the axle 124 is a separate piece. In yet another embodiment, the connection feature 126, the axle 124, and the spine 122 are each a separate piece.

Figure 5:
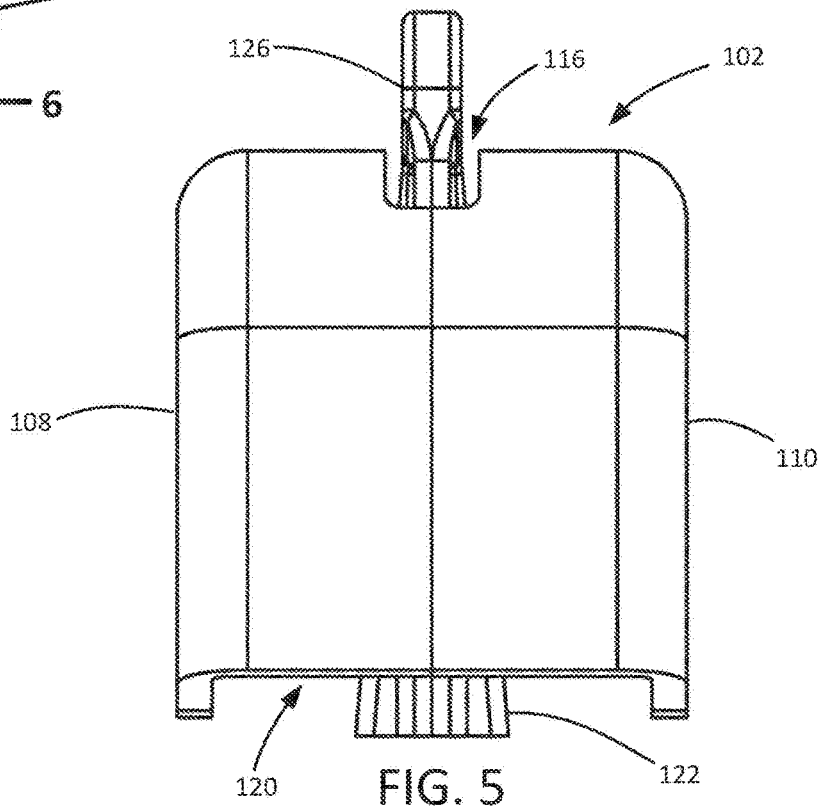
FIG. 5 is a side elevation view of the head of the bobblehead key chain in FIG. 1.

As illustrated in FIG. 5, the spine 122 of the pivot mechanism 104 extends through the top opening 116 of the head 102, such that the connection feature 126 is positioned outside of the interior space 112 of the head 102. The connection feature 126 may be used to fasten the bobblehead key chain 100 to a key ring, to a key or multiple keys, or to other objects such as a backpack or purse. In some embodiments, the connection feature 126 directly fastens the bobblehead key chain 100 to the desired object. In other embodiments, the connection feature 126 fastens to an intermediate ring, clip, clasp, carabiner, chain, or other suitable securing feature that is then fastened to the desired object. By fastening the bobblehead key chain 100 to an object using the pivot mechanism 104, as opposed to the upper surface 114 of the head 102, the center of gravity is advantageously fixed below the connection feature 126. The pivot mechanism 104 is also studier than the head 102 as a point of attachment.

Figure 6:
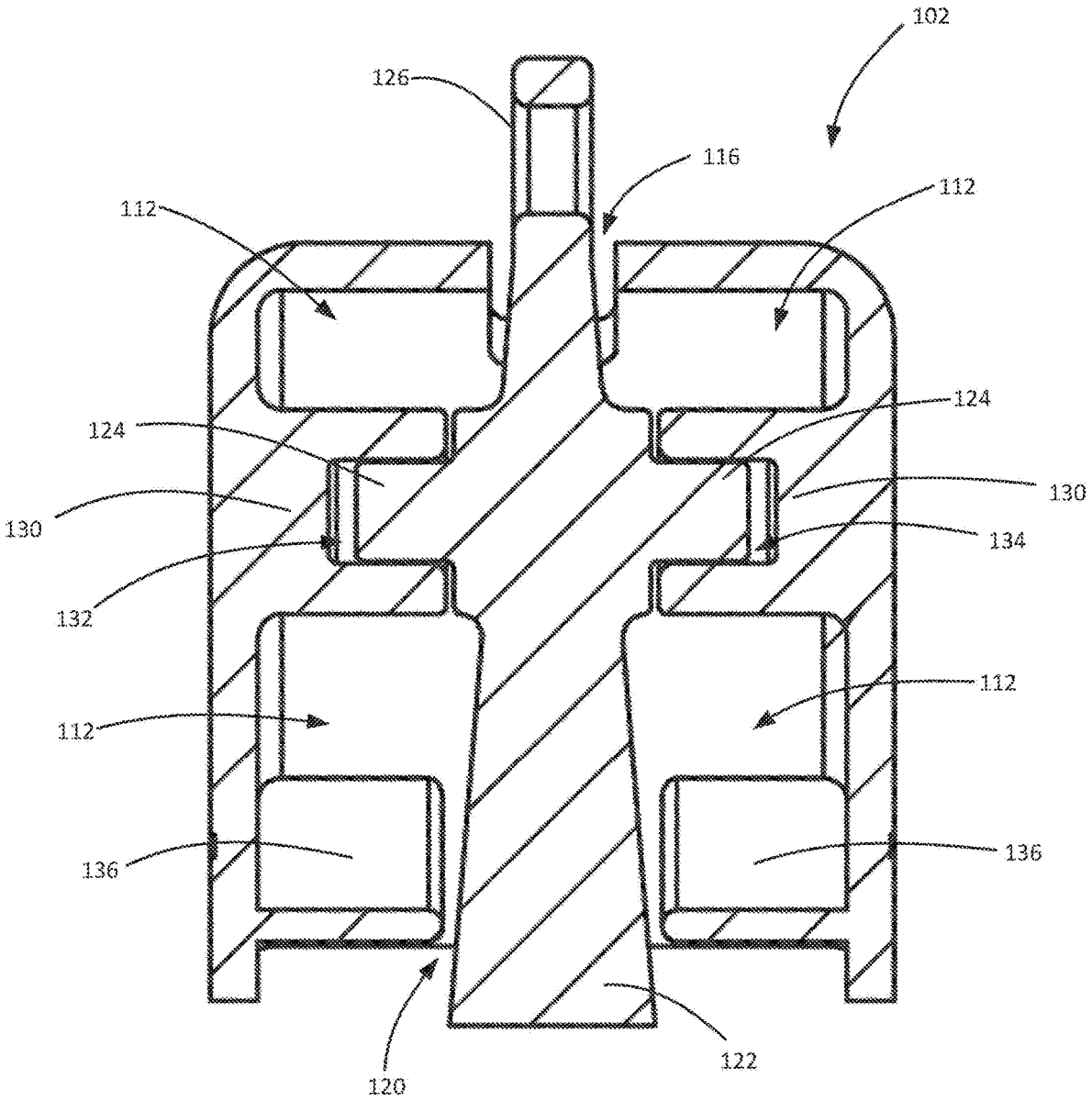
FIG. 6 is a side cross-section view along line 6-6 of the head of the bobblehead key chain in FIGS. 1 and 4.
Figure 8B:
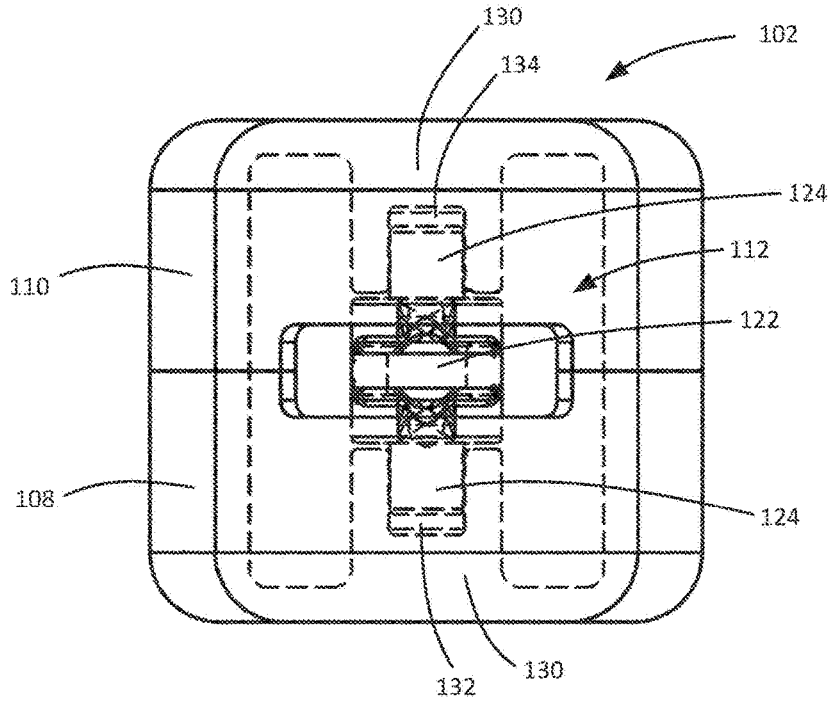
FIG. 8B is a top partial cutaway view of the head of the bobblehead key chain in FIG. 1.

As exemplified in FIGS. 6 and 7, the axle 124 of the pivot mechanism 104 is retained by a mounting feature 130 in the interior space 112 of the head 102. FIG. 8B depicts an alternative view of the pivot mechanism 104 and the mounting feature 130 of FIGS. 6 and 7. The mounting feature 130 may be a unitary construction or made up of separate pieces. In one embodiment, the mounting feature 130 includes a pair of recesses 132, 134 within the interior space 112 of the head 102. A first recess 132 holds one end of the axle 124, and a second recess 134 holds the opposite end of the axle 124, such that the head 102 is securely connected to the pivot mechanism 104 while also being allowed to pivot back and forth on the axle 124. In another embodiment, the mounting feature 130 is a set of bearings through which the ends of the axle 124 are disposed.

Because the bobblehead key chain 100 is not connected to objects via the head 102, the head 102 is able to produce a natural bobbling head movement on the axle 124 (e.g., in response to gravity or inertia) while not being tied to an attachment point. Depending on the orientation of the axle 124 within the head 102, the bobbling movement of the head 102 may either be forwards and backwards or side to side.

Figure 9:
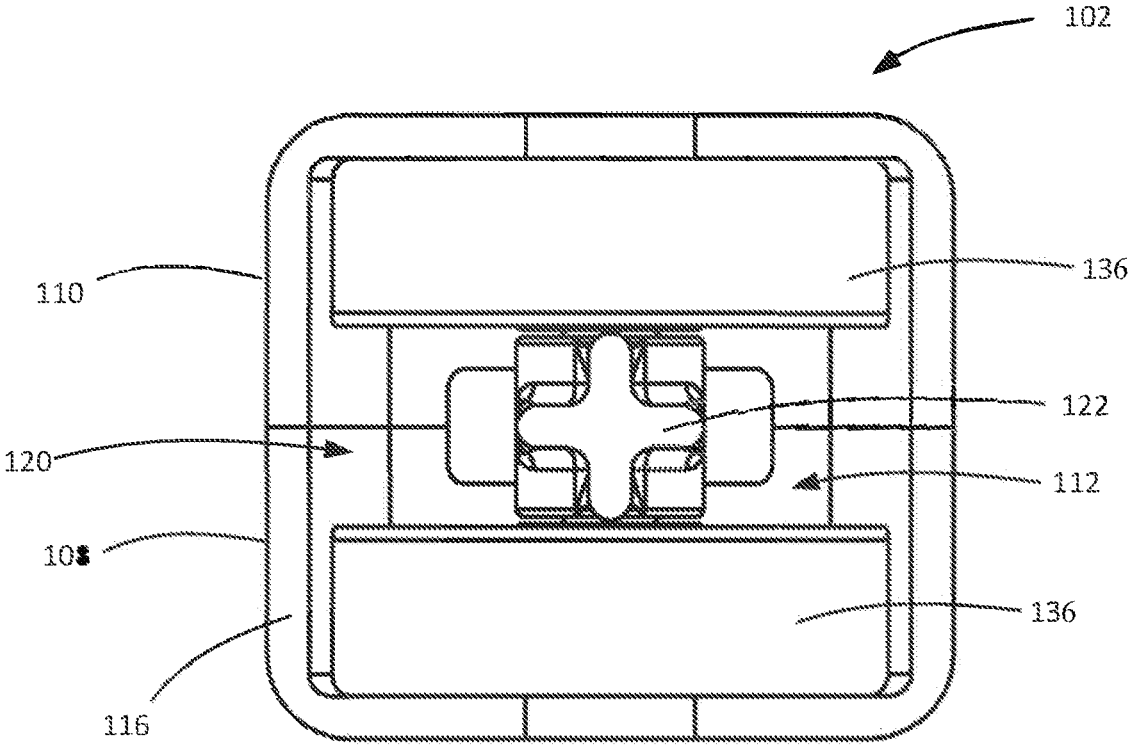
FIG. 9 is a bottom elevation view of the head of the bobblehead key chain in FIG. 1.

In some embodiments, the bobblehead key chain 100 includes bottom stops 136 integrated within the interior space 112 of the head 102. Although the bottom stops 136 of FIG. 9 are generally rectangular, it will be appreciated that bottom stops 136 of different sizes and shapes may be suitable depending on the size and shape of the head 102. In one embodiment, the bottom stops 136 are located at the edge of the bottom opening 120. The bottom stops 136 protect the spine 122 of the pivot mechanism 104 from bending stresses that might weaken the spine 122 or displace the center of gravity. The bottom stops 136 also protect the head 102 and pivot mechanism 104 from tampering by a user of the bobblehead key chain 100. Nevertheless, in other embodiments, the bottom stops 136 are omitted to allow the head 102 to bobble slightly in a direction parallel to the axis.

In some embodiments, the spine 122 of the pivot mechanism 104 extends through the bottom opening 120 of the head 102 and connects at its lower end to a body 106 of the key chain 100. In one embodiment, the spine 122 and the body 106 are molded or otherwise formed as a unitary piece. Casting the spine 122 and the body 106 as one solid piece can help to minimize the risk of breakage or separation of the head 102 and the body 106. Alternatively, the body 106 may be connected to the spine 122 using snaps, screws, clips, glue, pins, or other suitable fasteners.

The bobblehead key chain 100 as exemplified in FIG. 1 includes a bell-shaped head 102 and an oval body 106. It will be appreciated that the head 102 and the body 106 may be formed of various shapes and sizes and may include faces, arms, hands, legs, feet, tail, and other features or appendages. The bobblehead keychain 100 may be shaped so as to resemble as people, animals, fictional characters, or other objects. The bobblehead key chain 100 may be constructed entirely of plastic or may be constructed of any other suitable material or combination of materials, such as resin, wax, fabric, metal, or the like.

It is to be understood that were the specification or claims refer to relative terms, such as "front," "rear," "lower," "upper," "horizontal," "vertical," "above," "below," "up," "down," "top," "bottom," "left," and "right" as well as derivatives thereof (e.g., "horizontally," "downwardly," "upwardly" etc.), such reference is used for the sake of clarity and not as terms of limitation, and should be construed to refer to the orientation as then described or as shown in the drawings under discussion. These relative terms are for convenience of description and do not require that the apparatus be constructed or the method to be operated in a particular orientation. Terms, such as "connected," "connecting," "attached," "attaching," "join" and "joining" are used interchangeably and refer to one structure or surface being secured to another structure or surface or integrally fabricated in one piece.

The preceding detailed description of exemplary embodiments of the invention makes reference to the accompanying drawings, which show the exemplary embodiment by way of illustration. While these exemplary embodiments are described in sufficient detail to enable those skilled in the art to practice the invention, it should be understood that other embodiments may be realized, and that logical and mechanical changes may be made without departing from the spirit and scope of the invention. For example, the steps recited in any of the method or process claims may be executed in any order and are not limited to the order presented. Thus, the preceding detailed description is presented for purposes of illustration only and not of limitation, and the scope of the invention is defined by the preceding description and with respect to the attached claims.

Thus, the invention is well adapted to carry out the objects and attain the ends and advantages mentioned above as well as those inherent therein. While the inventive concept has been described and illustrated herein by reference to certain illustrative embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A bobblehead key chain, comprising:
- a head comprising:
  - a top opening located on an upper surface of the head,
  - a bottom opening located on a lower surface of the head,
  - a first portion,
  - a second portion connected to the first portion,
  - an interior space formed within the first and second portions, and
  - a mounting feature having a pair of recesses, the mounting feature located
  - within the interior space of the head; and
- a pivot mechanism comprising:
  - a spine with a connection feature at a top of the spine wherein the spine extends through the top opening and the bottom opening, and an axle that extends from the spine and is retained by the pair of recesses; and
- a body connected to a bottom of the spine such that the body is spaced below the lower surface of the head.

2. The bobblehead key chain of claim 1, wherein the first portion and the second portion are connected by snaps, screws, clips, glue, or pins.

3. The bobblehead key chain of claim 1, wherein the body is a unitary piece with the spine.

4. The bobblehead key chain of claim 1, wherein the head and the body are shaped to resemble a person, an animal, or a fictional character.

5. The bobblehead key chain of claim 1, wherein the head further comprises bottom stops within the interior space.

6. The bobblehead key chain of claim 1, wherein the spine is reinforced with structural ribs.

7. A bobblehead key chain, comprising:
- a head comprising
  - a top opening located on an upper surface of the head,
  - a bottom opening located on a lower surface of the head,
  - an interior space formed between the top opening and the bottom opening, and
  - a mounting feature having a pair of recesses, the mounting feature located within the interior space;

a pivot mechanism disposed through the head and extending through the top opening of the head and the bottom opening of the head, the pivot mechanism having a spine having a top end and a bottom end, a connection feature at the top end of the spine, and an axle that extends from the spine and is retained by the pair of recesses; and a body connected to the bottom end of the spine such that the body is spaced below the lower surface of the head.

8. The bobblehead key chain of claim 7, wherein the head further comprises bottom stops within the interior space.

9. A method of making a bobblehead key chain, comprising the steps of:

constructing a pivot mechanism, wherein the pivot mechanism comprises:

a spine having an upper end and a lower end;

an axle extending from the spine, and a connection feature above the axle at the upper end of the spine;

forming a head around the spine of the pivot mechanism, the head having a top opening in an upper surface of the head;

a bottom opening in a lower surface of the head such that the axle is retained in a mounting feature of the head and the spine extends through the top opening and bottom opening, wherein the step of forming the head around the spine further comprises the step of connecting a first portion of the head to a second portion of the head;

fastening the connection feature to a key ring; and forming a body at the lower end of the spine, such the body and the spine are a unitary piece and the body is spaced below the lower surface of the head.

10. The method of claim 9, wherein the step of forming the head around the spine further comprises the step of connecting the first portion of the head to the second portion of the head with snaps, screws, clips, glue, or pins.

* * * * *